US010576496B2

(12) United States Patent
Tamura

(10) Patent No.: US 10,576,496 B2
(45) Date of Patent: Mar. 3, 2020

(54) ELECTROSTATIC COATING METHOD AND GUN FOR ELECTROSTATIC COATING

(71) Applicant: TAIKISHA LTD, Tokyo (JP)

(72) Inventor: Yoshinobu Tamura, Sagamihara (JP)

(73) Assignee: TAIKISHA LTD, Tokyo (JP)

( * ) Notice: Subject to any disclaimer, the term of this patent is extended or adjusted under 35 U.S.C. 154(b) by 588 days.

(21) Appl. No.: 14/362,524

(22) PCT Filed: Sep. 18, 2012

(86) PCT No.: PCT/JP2012/073855
§ 371 (c)(1),
(2) Date: Jun. 3, 2014

(87) PCT Pub. No.: WO2013/042666
PCT Pub. Date: Mar. 28, 2013

(65) Prior Publication Data

US 2015/0165474 A1 Jun. 18, 2015

(30) Foreign Application Priority Data

Sep. 20, 2011 (JP) ..... 2011-205203

(51) Int. Cl.
*B05B 5/025* (2006.01)
*B05D 1/04* (2006.01)
(Continued)

(52) U.S. Cl.
CPC ..... *B05D 1/04* (2013.01); *B05B 5/025* (2013.01); *B05B 5/03* (2013.01); *B05D 1/045* (2013.01); *B05D 7/52* (2013.01)

(58) Field of Classification Search
CPC ..... B05B 5/03; B05B 5/025; B05D 1/045; B05D 1/04; B05D 7/52
See application file for complete search history.

(56) References Cited

U.S. PATENT DOCUMENTS 3,591,080 A * 7/1971 Kock ..... B05B 5/03 239/705
4,502,629 A * 3/1985 McGhee ..... B05B 5/03 239/11
(Continued)

FOREIGN PATENT DOCUMENTS

CN 1162935 A 10/1997
CN 101014415 A 8/2007
(Continued)

OTHER PUBLICATIONS

Chinese Office Action, Application No. 2012800569810, dated Dec. 12, 2014.
(Continued)

*Primary Examiner* — Alexander M Weddle
(74) *Attorney, Agent, or Firm* — Sughrue Mion, PLLC; Richard C. Turner

(57) ABSTRACT

Provided is an electrostatic coating method using a conductor such as a metal or a conductive resin as a coating target surface 21, the method including coating the coating target surface 21 with a charged paint by ejecting the charged paint from a spray gun 1 in a state where generation of an electrostatic field between a spray gun 1 and the coating target surface 21 is prevented and generation of free ions is prevented.

2 Claims, 7 Drawing Sheets

(51) Int. Cl.
*B05B 5/03* (2006.01)
*B05D 7/00* (2006.01)

(56) References Cited

U.S. PATENT DOCUMENTS

| | | | | |
|---|---|---|---|---|
| 4,819,879 | A * | 4/1989 | Sharpless | B05B 5/0533 239/691 |
| 4,824,026 | A | 4/1989 | Tamura et al. | |
| 5,749,529 | A * | 5/1998 | Kazama | B05B 5/03 118/626 |
| 2003/0080220 | A1* | 5/2003 | Mather | B05B 1/04 239/690 |
| 2005/0175772 | A1 | 8/2005 | Worsham et al. | |
| 2006/0124780 | A1* | 6/2006 | Cooper | B05B 5/03 239/690 |

FOREIGN PATENT DOCUMENTS

| | | | |
|---|---|---|---|
| GB | 2 197 225 | A | 5/1988 |
| JP | 54-107940 | A | 8/1979 |
| JP | 63-28148 | U | 2/1988 |
| JP | 10-57846 | A | 3/1998 |
| JP | 2007-38081 | A | 2/2007 |

OTHER PUBLICATIONS

Communication dated Apr. 3, 2015, issued by the Japanese Patent Office in counterpart Japanese application No. 2011-205203.
Communication dated Jul. 24, 2015 from the State Intellectual Property Office of the P.R.C. in counterpart application No. 201280056981.0.
Communication dated Oct. 13, 2015, issued by the European Patent Office in corresponding European Application No. 12834334.0.
Communication dated Sep. 18, 2015, issued by the European Patent Office in corresponding European Application No. 12834334.0.
International Search Report for PCT/JP2012/073855 dated Dec. 18, 2012.
International Preliminary Report on Patentability for PCT/JP2012/073855 dated Mar. 25, 2014.
Written Opinion for PCT/JP2012/073855 dated Dec. 18, 2012.

* cited by examiner

ELECTROSTATIC COATING METHOD AND GUN FOR ELECTROSTATIC COATING

CROSS REFERENCE TO RELATED APPLICATIONS

This application is a National Stage of International Application No. PCT/JP2012/073855 filed Sep. 18, 2012, claiming priority based on Japanese Patent Application No. 2011-205203 filed Sep. 20, 2011, the contents of all of which are incorporated herein by reference in their entirety.

TECHNICAL FIELD

The present invention relates to an electrostatic coating method for a conductive coating target surface, and a gun for electrostatic coating.

BACKGROUND ART

Generally, electrostatic coating is a coating method of efficiently coating a coating target with a paint by use of an electrostatic force between the paint and the coating target. Here, the electrostatic force is caused to act by negatively charging paint particles and by forming an electrostatic field (lines of electric force) with application of a high voltage between the coating target as a grounding electrode and an electrode of a coating device side as a cathode. The electrostatic coating can produce effects such as improvement in coating efficiency (reduction in a coating time owing to improved wrap around), and improvement in transfer efficiency (reduction in an amount of paint used owing to an improved volume ratio of paint transferred on a coating target). Further, note that the wrap around indicates an effect of causing a paint applied from the front side of a coating target to wrap around the coating target and to be transferred onto the back side of the coating target.

Conventional electrostatic coating methods are classified, in accordance with a way of atomizing a paint, into three types, i.e., an air atomization method, an air-less atomization method, and a rotary atomization method (atomization with a bell or a disk). In addition, in accordance with the high-voltage application method for generating an electrostatic force, the conventional electrostatic coating methods are classified into a direct application method and a corona discharge method. The direct application method is applied only to the rotary atomization method, and the corona discharge method is mainly applied to the air atomization method and the air-less atomization method. Also, note that, as one type of the corona discharge method, there is an external charging method in which a corona discharge electrode and a paint spray unit are disposed separated from each other, and a paint is electrostatically charged in a space before reaching a coating target. This method is mainly used for a highly-conductive paint (such as an aqueous paint) through which the high voltage leaks from a paint route if a general method is used in which the corona discharge electrode is disposed in the paint spray unit.

The conventional electrostatic coating techniques are composed by a combination of the paint atomization methods and the high-voltage application methods, but use a common electrostatic coating mechanism. Specifically, in any combination, an electrostatic force is caused to act in such a way that paint particles are electrostatically charged to fly along an electrostatic field formed between a coating machine (actually, a corona discharge electrode or a rotary atomizing head) and a coating target.

PRIOR ART DOCUMENT

Patent Document

PATENT DOCUMENT 1: Japanese Patent Application Publication No. 2010-279931

SUMMARY OF THE INVENTION

Problem to be Solved by the Invention

However, the above-mentioned conventional electrostatic coating techniques have the following two problems.

The first problem is that, since this method involves forming an electrostatic field between a coating machine and a coating target, a coating target having a recess or a projection therein has problems. Specifically, the projection part having a strong electric field strength is likely to be coated with a film with an excessive thickness due to high transfer efficiency. In contrast, the recess part having no electric field formed or having only a weak electric field strength cannot be coated or can be coated only with a thin film because it is difficult for the paint to penetrate the recess part. The solution having been applied to this problem is to drop or cut the electrostatic coating voltage. However, such solution cannot be said to be a substantial solution because the effect expected to be produced by the electrostatic coating is reduced or decreased.

The second problem is that a large amount of ionized air, called as free ions, is generated together with the charged paint particles. The free ions have a mass significantly smaller than the charged paint particles, and therefore fly under the control of the electrostatic force unlike the paint particles on which the inertia force largely acts. As a result, the free ions fall not only over a coating target to be electrostatically coated, but also over a conductor existing in the surrounding, and thereby charge the conductor if the conductor is grounded insufficiently. Further, there is a possibility that such charging may cause electrostatic sparks to induce a fire. In addition, if the coating target is grounded insufficiently, a fire due to electrostatic sparks may be also induced.

As described above, the conventional electrostatic coating techniques have the problem that the recess part is difficult for the paint to penetrate, and the problem that free ions that may cause electrostatic sparks are generated.

The present invention was made in view of the above-mentioned circumstances, and an object of the invention is to provide an electrostatic coating method for a conductive coating target surface and a gun for the electrostatic coating that are capable of improving the penetration power of a paint to a recess part, and of preventing generation of electrostatic sparks.

Means for Solving the Problem

In order to attain the above-mentioned object, an electrostatic coating method according to the present invention is an electrostatic coating method using a conductor such as a metal or a conductive resin as a coating target surface, the method including coating the coating target with the charged paint (liquid paint) by ejecting the charged paint from an ejection source in a state where generation of an electrostatic field between the ejection source and the coating target surface is prevented and generation of free ions is prevented.

As a method of preventing the generation of the electrostatic field between the ejection source and the coating target surface and the generation of free ions, preferable is a method in which a high-voltage electrode is disposed to be in contact with a paint route inside a coating machine, instead of providing an electrode portion outside a gun such as a corona discharge electrode exposed outside, a high voltage from the high-voltage electrode is directly applied to a paint in the coating machine to charge the paint, and the charged paint is ejected from the ejection source.

Moreover, the volume specific resistance value of the paint is preferably 100 MΩcm or less, more preferably 50 MΩcm or less, and still more preferably 20 MΩcm or less. In addition, it should be noted that a low-resistant paint having a volume specific resistance value of 100 MΩcm or less has been used for electrostatic coating of an insulator but has not being used purposely for conventional electrostatic coating of a conductor. This is because the static electricity given to a coating target by the electrostatic coating easily flows to the ground and is not accumulated in the conductor. In contrast, in the above-mentioned method, wherein the high voltage from the high-voltage electrode is directly applied to a paint to charge the paint, and a low-resistant paint is more preferably used unlike the conventional electrostatic coating, because the paint having a high-resistant value cannot be sufficiently charged.

In the above-mentioned method, since the generation of the electrostatic field (macroscopic electrostatic field) between the ejection source and the coating target surface is prevented, the charged paint particles ejected from the ejection source do not fly along the electrostatic field but fly along the inertia and the air flow to approach the coating target surface. An explanation is made in a case where paint particles are negatively charged. When the paint particles come very near to the coating target surface, electrons having negative electric charges move to the inside of the coating target surface by receiving a repulsive force, and an atomic nucleus having a positive potential remains on the outside thereof to serve as a positive electrode, so that an electrostatic field is generated between the paint particles and the coating target surface. This electrostatic field is an electrostatic field generated between the paint particles and the coating target surface because the negatively charged paint particles approach the conductive coating target surface. Such a phenomenon is known as a mirror effect or a mirror image effect. Further, when the paint particles are positively charged, the paint particles attract the electrons on the coating target surface, so that the coating target surface serves as a negative electrode, which is the inverse of the above-mentioned case. Such a mirror effect leads to generation of an microscopic electrostatic field in the vicinity of the coating target surface, and an electrostatic attractive force thereof causes the paint particles to be transferred onto the coating target surface.

In this manner, the paint particles that fly along the inertia and the air flow and approach the coating target surface are transferred onto the coating target surface due to the electrostatic attractive force of the microscopic electrostatic field that is generated in the vicinity of the coating target surface, thereby the penetration power of a paint to a recess part is improved. Therefore, this makes it possible to equally coat the recess part and other parts (including a projection part), thereby attaining improvement in coating quality (the uniform film thickness of the coating). Moreover, the improvement in penetration power to the recess part can provide improvement in coating efficiency (the shortened period of time of the coating), and improvement in coating and transfer efficiency (reduction in the use amount of the paint, and reduction in not-transferred waste paint and discharged paint particles).

In addition, prevention of generation of free ions prevents generation of electrostatic sparks, thereby improving the safety.

Moreover, the above-mentioned coating target surface may include a region (non-conductive region) having weak conductivity or insulation property made of a non-conductive resin or the like.

With the above-mentioned method, because formation of the macroscopic electric field and generation of free ions are prevented, the amount of ions that reach the coating target surface is reduced, and the non-conductive region is prevented from being charged. In addition, application of the low-resistant paint enables the electric charges in the non-conductive region to move quickly to the conductive region, and makes it possible to keep the level of charging of the non-conductive region low, and perform continuous favorable electrostatic coating. In other words, even if the conductive region and the non-conductive region are present in a mixed manner in the coating target surface, both of the regions can be equally coated in the same step.

A gun for electrostatic coating according to the present invention is a gun for electrostatic coating that is used as the ejection source in the electrostatic coating method, and is provided with a paint supply path, a high-voltage electrode, and an ejection port. The paint supply path is a path through which a paint passes. The high-voltage electrode is provided in the paint supply path, and is configured to directly apply a high voltage to the paint passing through the paint supply path to charge the paint. The ejection port is provided on the tip or in the vicinity of the paint supply path, and is configured to eject the charged paint to the outside. In other words, this gun for electrostatic coating includes no electrode portion outside the gun such as a corona discharge electrode exposed outside.

Advantageous Effects of Invention

The present invention can improve the penetration power of a paint to a recess part, and prevent generation of electrostatic sparks.

MODE FOR CARRYING OUT THE INVENTION

Hereinafter, an embodiment of the present invention is explained with reference to the drawings. Further, note that, in the explanation below, the terms "upper" and "down" correspond to sides in the vertical direction in FIG. 1, and the terms "front" and "rear" correspond to left and right sides in FIG. 1.

Figure 1:
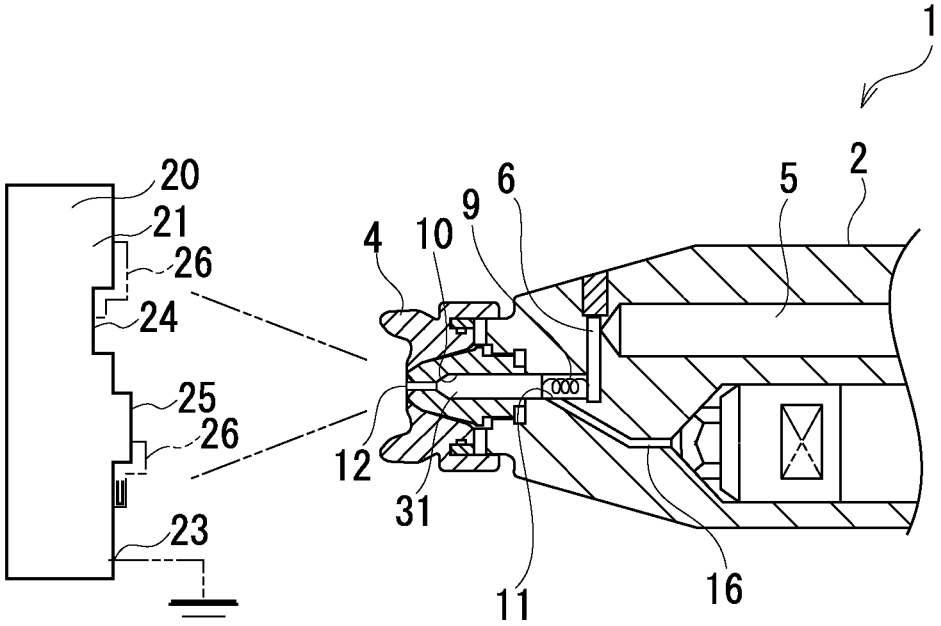
FIG. 1 is a cross-sectional view of a gun for electrostatic coating according to this embodiment.
Figure 2:
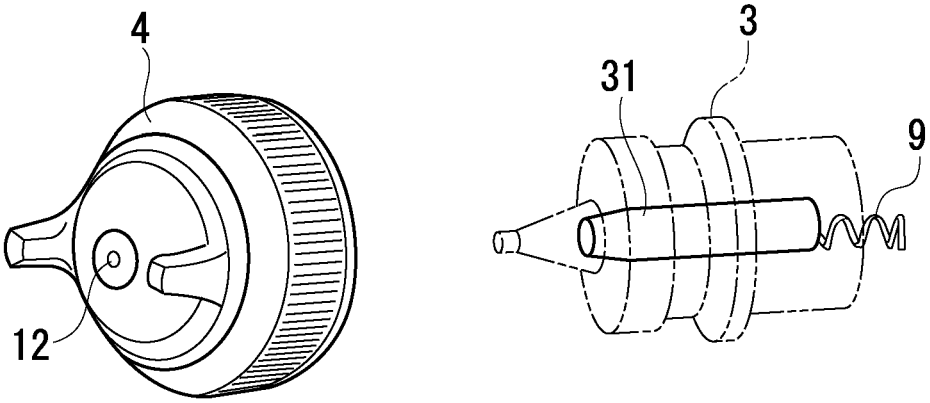
FIG. 2 is a exploded perspective view of the gun for electrostatic coating of FIG. 1.

As illustrated in FIG. 1, a spray gun (gun for electrostatic coating) 1 as an ejection source according to the embodiment is, for example, an automatic spray gun, and is used for electrostatic coating of a coating target surface 21 including a region having conductivity. In this embodiment, a case where the entire region of the coating target surface 21 has conductivity is explained. The spray gun 1 is provided with a gun main body 2 made of an insulating resin, a paint nozzle 3 made of an insulating resin and attached to a tip portion of the gun main body 2, and an air cap (of a type for formation of mist of a fan pattern, for example) 4 made of an insulating resin and attached to a front end portion of the gun main body 2 to cover an outer circumference of the paint nozzle 3.

In an upper portion inside the gun main body 2, housed is a cascade (high-voltage generation device) 5 in which a step-up transformer and a high-voltage rectification circuit constituting a high-voltage generation circuit are integrally molded, and in a front upper portion inside the gun main body 2, disposed downward is a connection rod 6 having conductivity. A front end of the cascade 5 abuts on the connection rod 6, and the cascade 5 and the connection rod 6 are electrically connected to each other.

A hole 10 is formed in a center portion of the paint nozzle 3, and the hole 10 houses therein and supports a high-voltage directly applying electrode (high-voltage electrode) 31 made of a metal. A rear end portion of the high-voltage directly applying electrode 31 is inserted into a hole 11 formed in the gun main body 2, and is electrically connected to the connection rod 6 via a spring 9. A front end of the hole 10 communicates with the outside via an ejection port 12.

The air cap 4 is provided with two types of air injection ports (illustration is omitted). One of the air injection ports functions to atomize an ejected paint (liquid paint) as atomized air, and the other of the injection ports functions to form mist of a fan pattern as pattern air.

A high-frequent voltage taken in from a power supply connector (no illustration) is supplied to the step-up transformer in the cascade 5 via a wiring cable (no illustration) in a grip 3. The supplied high-frequent voltage being increased by the step-up transformer is then further increased and simultaneously rectified by the high-voltage rectification circuit, and a direct-current high voltage of negative several tens of thousands of V is generated. The generated direct-current high voltage is supplied to the high-voltage directly applying electrode 31 from the cascade 5 via the connection rod 6 and the spring 9. Further, the high voltage to be applied is preferably from approximately 50 kV to 60 kV, for example.

A paint passage hole 16 that communicates with the hole 11 is formed in the gun main body 2, and the paint is supplied from the paint passage hole 16 to the hole 11. The paint that passes through the hole 10 is applied by being brought into direct contact with the high-voltage directly applying electrode 31, and the paint itself serves as a discharge electrode that supports an electric charge, and becomes negatively charged paint particles to be air-atomized and ejected from the ejection port 12. The paint is a low-resistant paint having a low volume specific resistance value. The volume specific resistance value of the paint is preferably 100 MΩcm or less, more preferably 50 MΩcm or less, and still more preferably 20 MΩcm or less.

The coating target surface 21 of a coating target 20 to which the spray gun 1 is opposed includes a shape of recesses and projections (a recess part 24 and a projection part 25), and a grounding part 23 of the coating target surface 21 is connected to a ground wire and grounded. The coating target surface 21 is formed of a conductor such as a metal or a conductive resin. Further, the coating target 20 may be either a conductor or an insulator as long as the coating target surface 21 has conductivity.

In coating of the coating target surface 21, in a state where generation of an electrostatic field between the spray gun 1 and the coating target surface 21 is prevented and generation of free ions is prevented, the charged paint is caused to be ejected from the spray gun 1 and is applied to the coating target surface 21.

The generation of an electrostatic field between the spray gun 1 and the coating target surface 21 and the generation of free ions are prevented such that by using the spray gun 1 having no corona discharge electrode exposed outside, a paint is directly applied with a high voltage from the high-voltage directly applying electrode to be negatively charged, and the charged paint is applied.

In this manner, the electrostatic coating according to the embodiment is essentially different from conventional common electrostatic coating in that in a state where generation of an electrostatic field between the spray gun 1 and the coating target surface 21 is prevented and generation of free ions is prevented, the charged paint is caused to be ejected from the spray gun 1.

In the conventional common electrostatic coating, a spray gun including a corona pin is used. The tip of the corona pin discharges corona to ionize the air, and forms an electrostatic field with the conductive coating target surface 21. The air ionized by the corona discharge flies along the formed electrostatic field. The spray gun ejects paint particles that are air-atomized to the electrostatic field. The ejected paint particles are charged by receiving the electric charge from the ionized air, and transferred to the coating target surface 21 while receiving the attractive force along the electrostatic field. In this case, the air, among the ionized air, that gives no electric charge to the paint particles is called as a free ion, and flies along the orbit mainly dominated by the formed electrostatic field. The electrostatic field to be formed has a strong electric field strength with respect to the projection part 25 of the coating target surface 21, and has a weak electric field strength with respect to the recess part 24 thereof. With this, the paint particles are likely to be excessively transferred onto the projection part 25, and are less likely to penetrate the recess part 24.

In contrast, in the electrostatic coating according to the embodiment, because generation of an electrostatic field (macroscopic electrostatic field) between the spray gun 1 and the coating target surface 21 is prevented, the paint particles being negatively charged that are air-atomized and ejected from the spray gun 1 do not fly along the electrostatic field but fly along the inertia and the air flow to approach the coating target surface 21. When the paint particles approach the coating target surface 21 at the nearest, a microscopic electrostatic field is generated in the vicinity of the coating target surface 21 due to the mirror effect, and an electrostatic attractive force thereof causes the paint particles to be transferred onto the coating target surface 21. In other words, the paint particles that fly along the inertia and the air flow and approach the coating target surface 21 are transferred to the coating target surface 21 by the electrostatic attractive force of the microscopic electrostatic field generated in the vicinity of the coating target surface 21, thereby the penetration power of the paint into the recess part 24 is improved. This allows the recess part 24 and other parts (including the projection part 25) to be equally coated, thereby making it possible to improve the coating quality (the uniform film thickness of the coating). Moreover, improvement in penetration power to the recess part 24 can provide improvement in coating efficiency (the reduction in coating time) and improvement in coating and transfer efficiency (reduction in the amount of paint used).

In addition, prevention of generation of free ions prevents generation of electrostatic sparks, thereby improving the safety.

<Effect Confirmation Experiment 1>

Next, an effect confirmation experiment 1 is explained.

In this experiment, air-less manual coating (non-electrostatic coating) was compared with the electrostatic coating in the present invention. Further, note that, in the electrostatic coating, the high voltage applied to a paint is 55 kV, and the volume specific resistance value of the paint is 1 MΩcm.

In the air-less manual coating, the time period of the coating was 180 seconds, the film thickness of the coating varied in the range of from 40 to 80 μm, and the transfer efficiency was less than 50%.

In contrast, in the electrostatic coating, the time period of the coating was shortened to 90 seconds, the film thickness of the coating was uniformed to the range of from 40 to 50 μm, and the transfer efficiency was 73%, so that improvement in coating efficiency (reduction in coating time), improvement in coating quality (the uniform film thickness of the coating) and improvement in coating and transfer efficiency (reduction in the amount of paint used) were confirmed.

<Effect Confirmation Experiment 2>

Next, an effect confirmation experiment 2 is explained.

In this experiment, the transfer efficiency of electrostatic coating was measured, the electrostatic coating was performed in such a manner that a 500-cc plastic bottle with a surface having recesses and projections is used as a coating target, the surface entire region of the plastic bottle is covered with aluminum foil to form a conductive coating target surface having recesses and projections, an automatic spray gun for electrostatic coating attached to a reciprocator is made to reciprocate in the vertical direction by three round-trips and eject a paint only in the range of the plastic bottle. As for the paints, six types of low-resistant paints (1 MΩcm, 5 MΩcm, 20 MΩcm, 49 MΩcm, 103 MΩcm, and 193 MΩcm) with different volume specific resistance values were used. The high voltage applied to the paints was 55 kV (electrostatic), and coating at 0 kV (non-electrostatic) was also performed for comparison.

Figure 3:
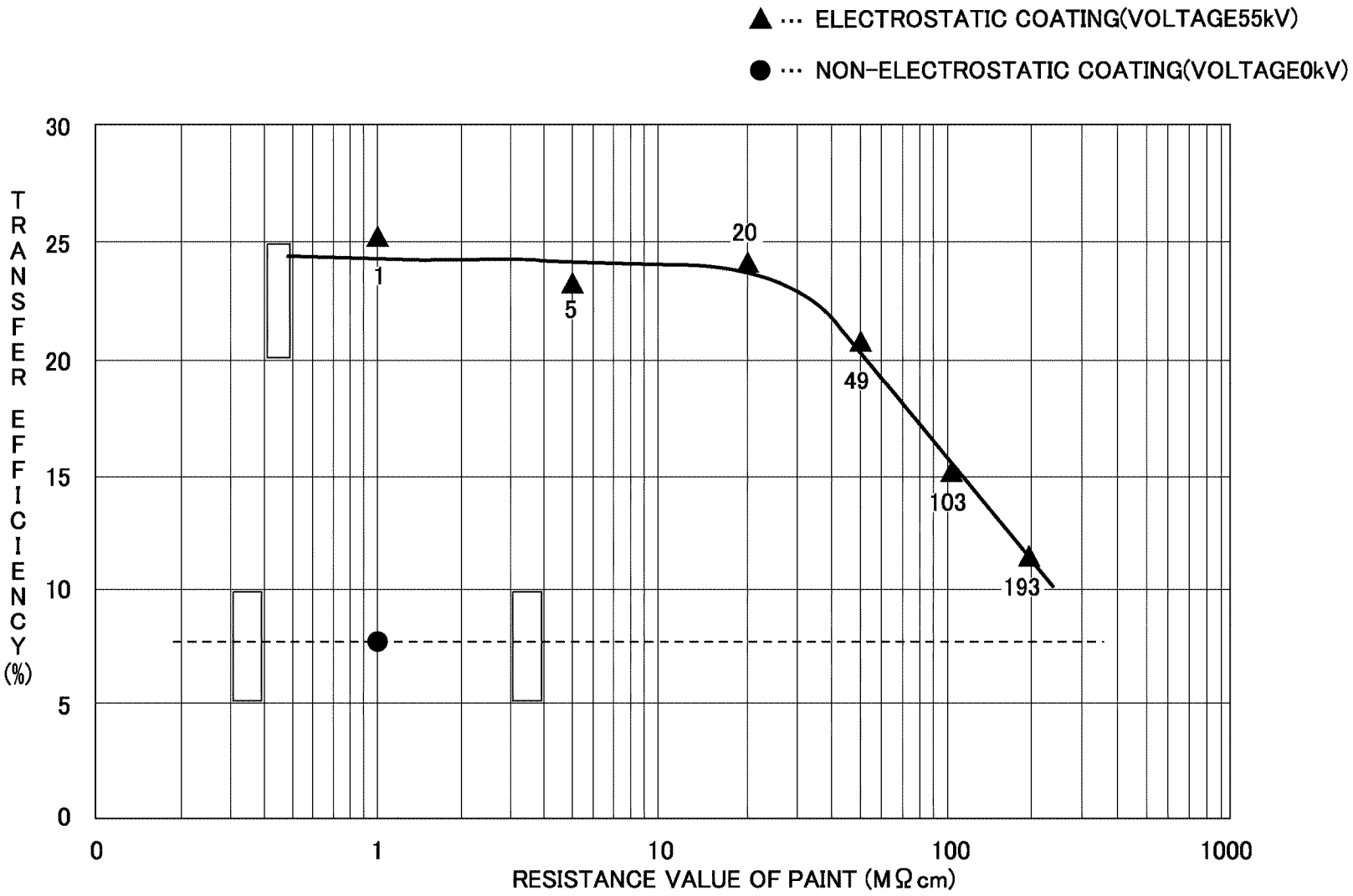
FIG. 3 is a graph illustrating a result of an effect confirmation experiment 2.
Figure 4:
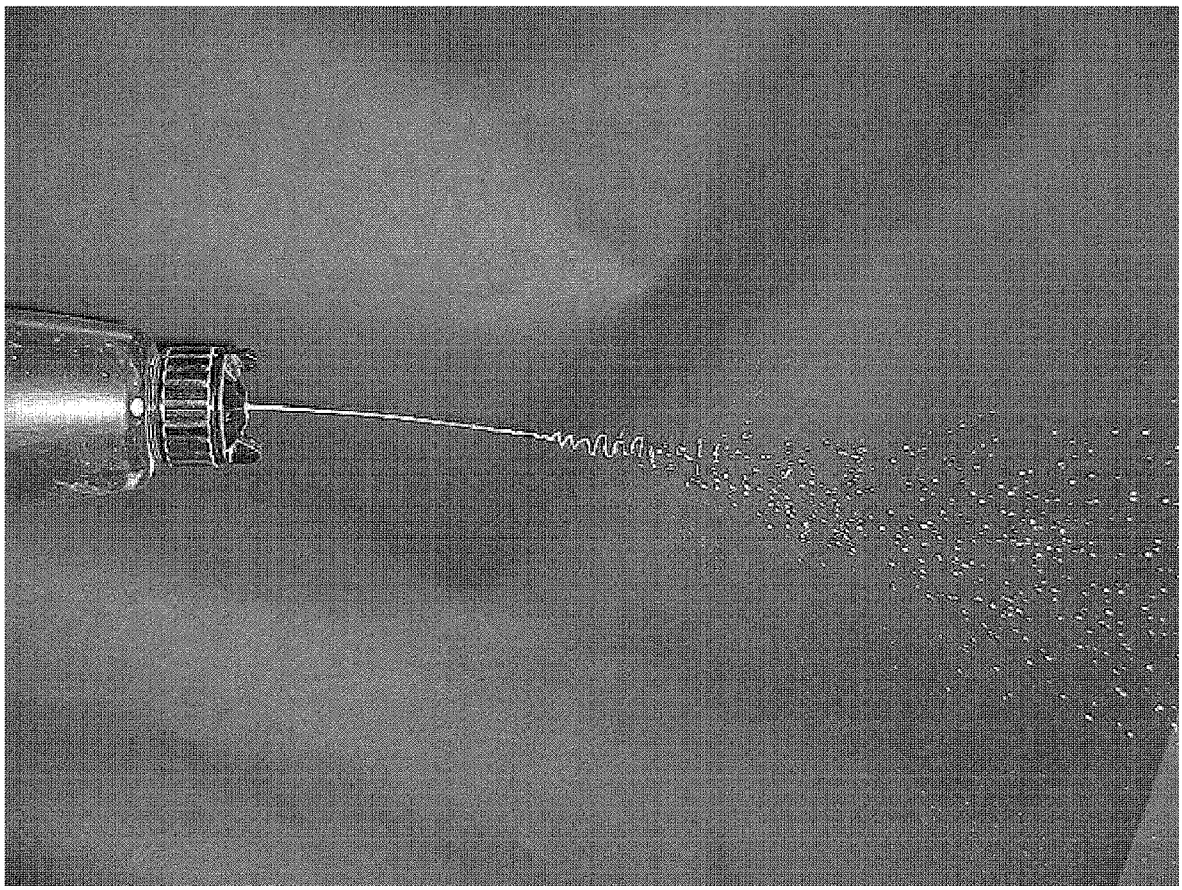
FIG. 4 is a photograph obtained by taking a state where a paint having a volume specific resistance value of 200 MΩcm under application of a voltage of 60 kvolts is ejected in a water-gun-like manner after spraying air is stopped.
Figure 5:
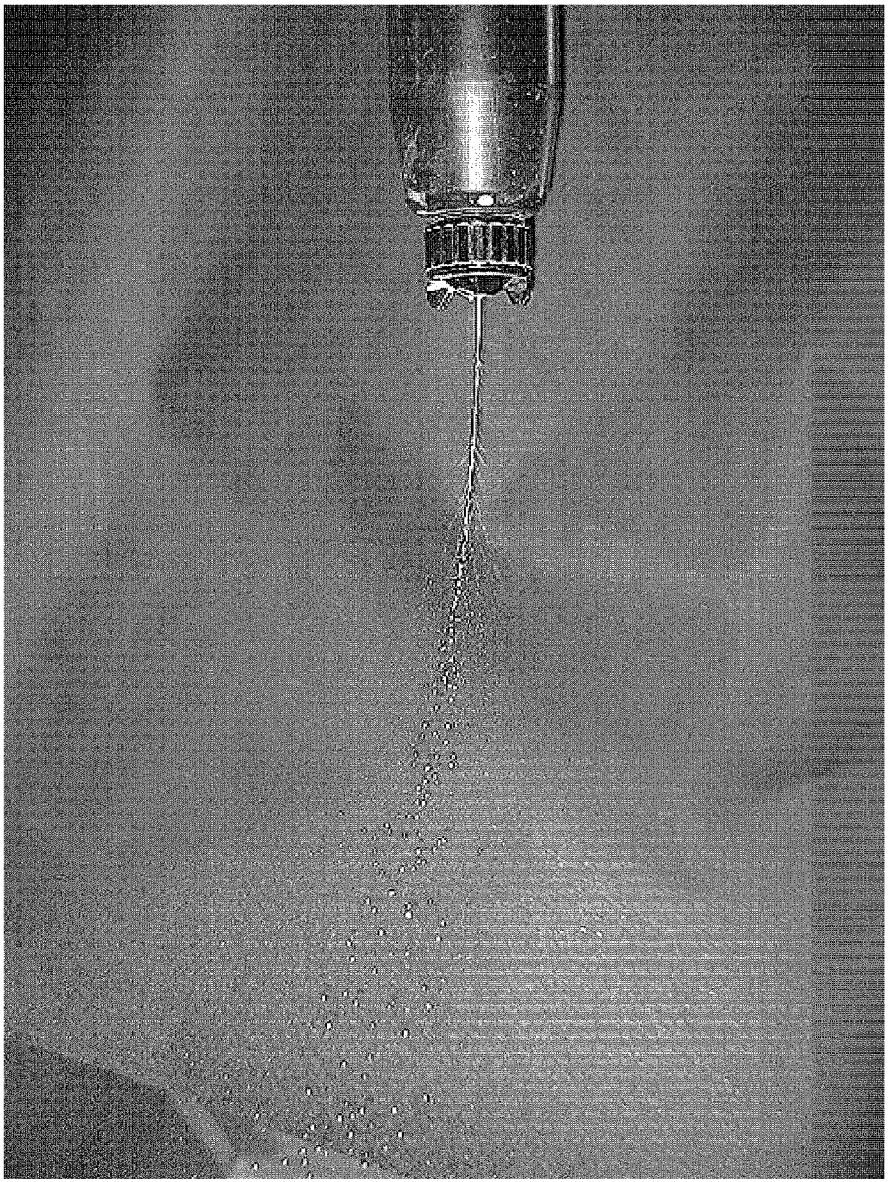
FIG. 5 is a photograph obtained by taking a state where a paint having a volume specific resistance value of 100 MΩcm under application of a voltage of 60 kvolts is ejected in a water-gun-like manner after spraying air is stopped
Figure 6:
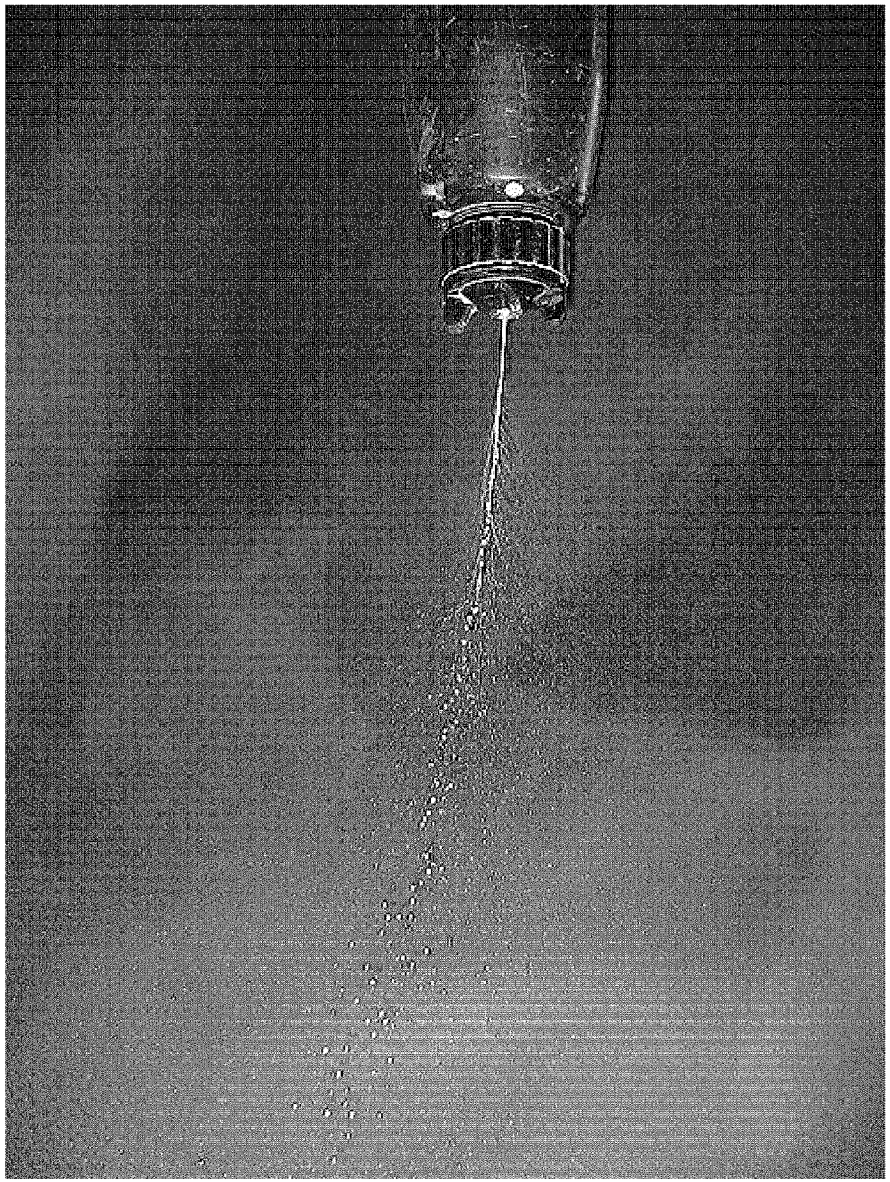
FIG. 6 is a photograph obtained by taking a state where a paint having a volume specific resistance value of 50 MΩcm under application of a voltage of 60 kvolts is ejected in a water-gun-like manner after spraying air is stopped
Figure 7:
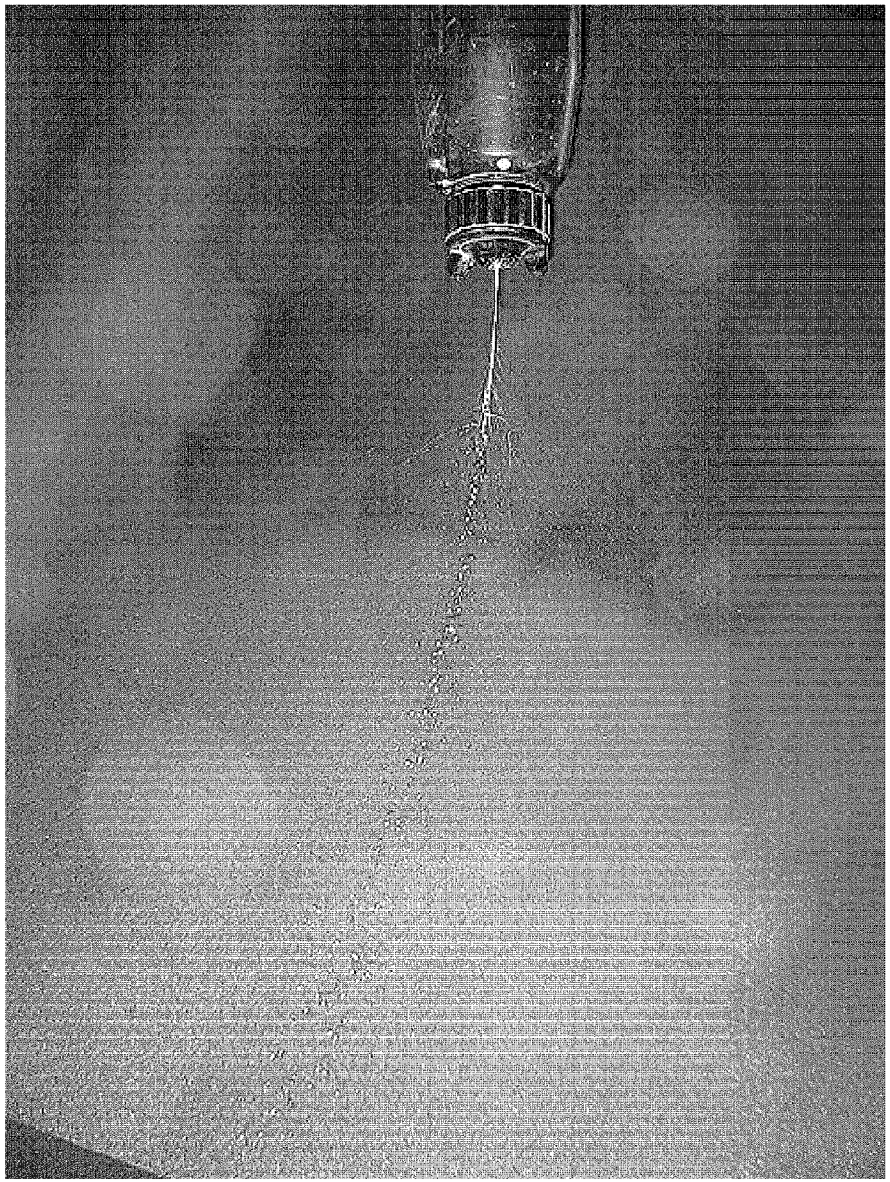
FIG. 7 is a photograph obtained by taking a state where a paint having a volume specific resistance value of 20 MΩcm under application of a voltage of 60 kvolts is ejected in a water-gun-like manner after spraying air is stopped.
Figure 8:
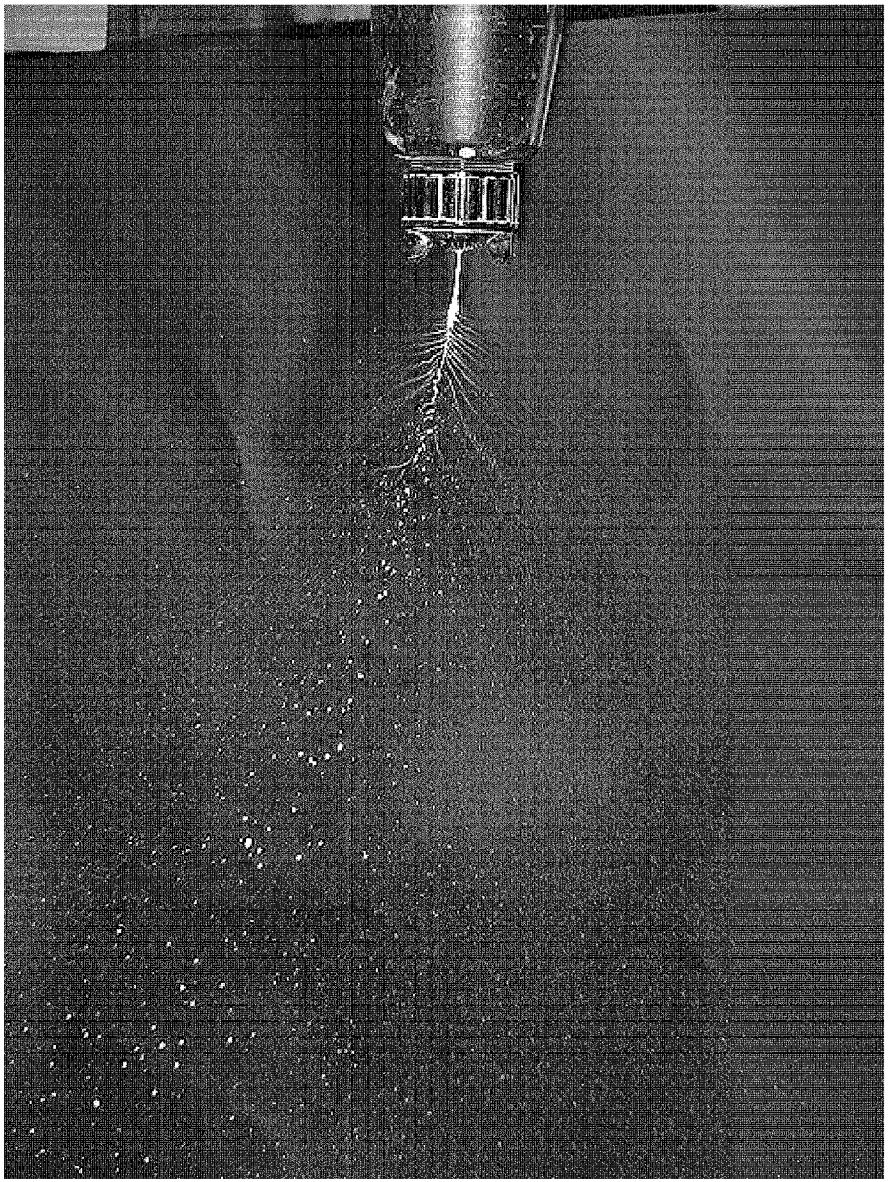
FIG. 8 is a photograph obtained by taking a state where a paint having a volume specific resistance value of 10 MΩcm under application of a voltage of 60 kvolts is ejected in a water-gun-like manner after spraying air is stopped.

FIG. 3 illustrates a result of the effect confirmation experiment 2. This result shows that the volume specific resistance value of the paint is preferably 100 MΩcm or less, more preferably 50 MΩcm or less, and still more preferably 20 MΩcm or less.

<Effect Confirmation Experiment 3>

Next, an effect confirmation experiment 3 is explained with reference to FIG. 4 to FIG. 8. In this experiment, the state of a paint being applied due to a contact with the high-voltage directly applying electrode 31 was observed.

FIG. 4 to FIG. 8 are photographs, each of which obtained by taking a state where a paint was ejected from the ejection port 12 in a water-gun-like manner under conditions where injection of the air from the air cap 4 being a paint atomizing unit of the gun main body was completely stopped, the application voltage was fixed to 60 kV, and the volume specific resistance value of the paint was changed. The volume specific resistance value was 200 MΩcm in FIG. 4, 100 MΩcm in FIG. 5, 50 MΩcm in FIG. 6, 20 MΩcm in FIGS. 7, and 10 MΩcm in FIG. 8.

As apparent from these figures, it was confirmed that while a paint of a thread-like liquid form of 200 MΩcm (FIG. 4) was a thread-like liquid of a water gun shape, a paint of a thread-like liquid form of 100 MΩcm (FIG. 5) was spread and atomized in the spine pattern due to electrostatic repulsion of the thread-like liquid at a point several centimeters away from the ejection. Moreover, it was confirmed that the spreading and atomization in the spine pattern is generated at an early stage and the spine pattern also becomes more prominent because as the volume specific resistance value of the paint becomes lower, the voltage drop in the paint of a thread-like liquid form becomes smaller to raise the effective voltage.

In addition, note that, in the above-mentioned embodiment, although the spray gun 1 of an air spray type has been explained as a gun for electrostatic coating that directly applies the high voltage to a paint to negatively charge the paint, a gun for electrostatic coating in the present invention is not limited thereto, and may be an air-less spray gun having an internal structure in which a high voltage is directly applied to a paint to negatively charge the paint and a structure in which a high-voltage applying conductor for generating free ions (such as corona electrode pin, metal bell cup, metal spray cap, or metal spray nozzle) is insulated, or a rotary atomizing gun.

Moreover, in the above-mentioned embodiment, although the case where the paint particles are negatively charged by using the electrode at the side of the coating device as a cathode has been explained, the paint particles may be positively charged by using the electrode at the side of the coating device as an anode.

Moreover, the coating target surface 21 may include regions (non-conductive regions) 26 having weak conductivity or insulation property and made of a non-conductive resin or the like, as illustrated by two-dot chain lines in FIG. 1. Further, note that, FIG. 1 illustrates an example in which the conductive coating target surface is partially covered with non-conductive resin plates to use the outer surfaces of the resin plates as parts of the coating target surface 21.

With the electrostatic coating method in the present invention, because formation of the macroscopic electric field and generation of free ions are prevented, the amount of ions reaching the coating target surface 21 is reduced, and the non-conductive region 26 is prevented from being charged. In addition, application of the low-resistant paint makes it possible to keep the level of charging of the non-conductive region 26 low, and perform continuous favorable electrostatic coating. In other words, even if the conductive region and the non-conductive region 26 are present in a mixed manner in the coating target surface 21, both of the regions can be equally coated in the same step.

As described above, although the embodiment to which the invention made by the present inventor is applied has been explained, the invention is not limited by the description and the drawings that constitute a part of the disclosure of the present invention by way of the above-mentioned embodiment. In other words, it is needless to say that other embodiments, examples, operation techniques, and the like that can be made by a person skilled in the art on the basis of the embodiment are all included in the scope of the present invention.

INDUSTRIAL APPLICABILITY

The present invention is widely applicable to electrostatic coating of a conductive coating target surface.

EXPLANATION OF THE REFERENCE NUMERALS

1 spray gun (ejection source, gun for electrostatic coating)
2 gun main body
3 paint nozzle
4 air cap
5 cascade (high-voltage generation device)
10 hole (paint supply path)
12 ejection port
20 coating target
21 coating target surface
23 grounding part
24 recess part
25 projection part
26 non-conductive region
31 high-voltage directly applying electrode

The invention claimed is:

1. A gun for electrostatically coating a coating target, the gun comprising:

a main body;

a paint nozzle which is made of an insulating resin and attached to a tip of the main body;

a paint supply path that is disposed within the paint nozzle and through which a liquid paint passes;

a voltage electrode which is entirely disposed within a hole formed in a center portion of the paint nozzle without a portion of the electrode being exposed outside the gun, is in direct contact with the liquid paint that passes through the paint nozzle, and is configured to directly apply a voltage to the liquid paint to charge the liquid paint;

a high-voltage generator that is disposed in the main body and extends in a longitudinal direction of the gun;

a connection rod that has a first contact point with the high-voltage generator in the main body and a second contact point with a spring that is connected to the voltage electrode in the center portion of the paint nozzle, and extends from the first contact point to the second contact point in a direction perpendicular to the longitudinal direction of the gun; and an air cap that covers the paint nozzle and is provided with an ejection port configured to eject the charged liquid paint outside the gun.

2. The gun according to claim 1, wherein the voltage electrode negatively charges the liquid paint that passes through the paint nozzle, and wherein the air cap atomizes the negatively charged liquid paint as atomized air and forms mist of a fan pattern.

* * * * *